US006876327B2

(12) United States Patent
Collins

(10) Patent No.: US 6,876,327 B2
(45) Date of Patent: Apr. 5, 2005

(54) NON-PLANAR RINGED ANTENNA SYSTEM

(75) Inventor: Spencer Collins, Dahlgren, VA (US)

(73) Assignee: Her Majesty the Queen in right of Canada, as represented by the Minister of National Defense, Ontario (CA)

( * ) Notice: Subject to any disclaimer, the term of this patent is extended or adjusted under 35 U.S.C. 154(b) by 0 days.

(21) Appl. No.: 10/388,628

(22) Filed: Mar. 17, 2003

(65) Prior Publication Data

US 2003/0184479 A1 Oct. 2, 2003

Related U.S. Application Data

(60) Provisional application No. 60/367,505, filed on Mar. 27, 2002.

(51) Int. Cl.[7] ..... H01Q 1/32
(52) U.S. Cl. ..... 343/700 MS
(58) Field of Search ..... 343/700 MS, 797, 343/769

(56) References Cited

U.S. PATENT DOCUMENTS

| | | | | | |
|---|---|---|---|---|---|
| 2,297,513 | A | | 9/1942 | Von Baeyer | 333/12 |
| 2,785,397 | A | | 3/1957 | Rust et al. | 343/753 |
| 3,434,146 | A | | 3/1969 | Petrich | 343/753 |
| 3,555,554 | A | | 1/1971 | Kuo | 343/895 |
| 4,608,572 | A | | 8/1986 | Blakney et al. | 343/792.5 |
| 4,636,798 | A | | 1/1987 | Seavey | 343/753 |
| 4,821,040 | A | * | 4/1989 | Johnson et al. | 343/700 MS |
| 5,132,698 | A | | 7/1992 | Swineford | 343/846 |
| 6,040,805 | A | | 3/2000 | Huynh et al. | 343/785 |
| 6,160,522 | A | * | 12/2000 | Sanford | 343/769 |
| 6,278,407 | B1 | * | 8/2001 | Ashjaee et al. | 343/700 MS |
| 2003/0122712 | A1 | * | 7/2003 | Rawnick et al. | 343/700 MS |
| 2004/0056818 | A1 | * | 3/2004 | Sledkov | 343/797 |

* cited by examiner

*Primary Examiner*—Don Wong
*Assistant Examiner*—Huedung X. Cao
(74) *Attorney, Agent, or Firm*—Oblon, Spivak, McClelland, Maier & Neustadt, P.C.

(57) ABSTRACT

An antenna system that permits the size of the ground plane to be reduced while mitigating the negative performance impacts normally associated with sub-optimal ground plane size. The antenna system comprises a ground plane, a radiating element and an isolated conductive structure for electromagnetically enclosing the radiating element. A first current on the radiating element induces a second current on the ground plane proximate the isolated conductive structure thereby inducing a third current on the isolated conductive structure opposing the second current wherein the third current creates an electromagnetic field.

30 Claims, 10 Drawing Sheets

NON-PLANAR RINGED ANTENNA SYSTEM

CROSS-REFERENCE TO RELATED APPLICATIONS

Benefit and priority is claimed to U.S. provisional application Ser. No. 60/367,505 filed Mar. 27, 2002. The 60/367,505 application is currently pending and is hereby incorporated by reference into this application.

FIELD OF INVENTION

The present invention relates to the field of radio frequency antenna systems and in particular to configurations of antenna systems of the microstrip type.

BACKGROUND OF THE INVENTION

During recent years, technology has provided for the ever-decreasing size of office products and personal communications systems (PCS). Devices such as laptop computers, personal digital assistants (PDA) and cell phones continue to become both lighter and smaller. Although the market demands a wireless network to connect these devices, certain technical challenges exist in the optimization of such a network. One of these challenges is the miniaturization of the antenna to be mounted to these devices.

For example, a conventional microstrip antenna designed to efficiently radiate at 2.4 GHz would require an antenna patch (radiating element) in the order of 6.25 cm. This dimension does not include the ground plane, which would extend this dimension further.

There are two basic parts of an antenna and therefore two basic considerations when reducing its size; the size of the radiating element and the size of the ground plane. The radiating element receives and transmits the electromagnetic signal, while the ground plane is required to reduce the effects of back lobe radiation, to lessen impedance variation, and to maintain the gain and the bandwidth. Most conventional methods of antenna miniaturization (such as shorting pins, slotting, and the use of high dielectric substrates) have focused on the miniaturization of the radiating element itself. While these methods have been effective, increased space considerations demand still further size reduction.

BRIEF SUMMARY OF THE INVENTION

In accordance with one aspect of the present invention, an antenna system comprising a ground plane, a radiating element electrically coupled to the ground plane, and an isolated conductive structure for electromagnetically enclosing the radiating element.

In accordance with another aspect of the present invention, an antenna system comprising a finite ground plane; a radiating element electrically coupled to the ground plane; an isolated conductive ring, not in contact with the ground plane, substantially surrounding the radiating element; and a grounded conductive ring, electrically coupled to the ground plane, substantially in contact with the perimeter of the ground plane.

In accordance with yet another aspect of the present invention, an antenna system comprising grounding means; radiating means electrically coupled to the grounding means; isolated conducting means arranged such that a first current on the radiating means induces a second current on the grounding means proximate the isolated conducting means thereby inducing a third current on the isolated conducting means opposing the second current wherein the third current creates an electromagnetic field.

In accordance with still another aspect of the present invention, an antenna system array comprising a plurality of antenna system elements each according to one of the aspects of the present inventions described here above.

Other aspects and features of the present invention will become apparent to those ordinarily skilled in the art upon review of the following description of specific embodiments of the invention in conjunction with the accompanying figures.

BRIEF DESCRIPTION OF DRAWINGS

The present invention will be described in conjunction with the drawings in which.

DETAILED DESCRIPTION OF THE INVENTION

As is well known to practitioners of the art, the size of a ground plane supporting a microstrip antenna is usually determined by the size of the device in which it is to be installed. Major factors that are affected by the truncation of the ground plane include the gain and the radiation pattern. The gain of the antenna is dependent on the ground plane size, and this dependence is periodic. The gain increases rapidly after a certain minimum radius. The gain will peak and then fall off as the ground plane size increases. For example, in the transverse magnetic TM11 mode the first peak is at a radius of 0.63λ. The 0.63λ radius ground plane has a 1 dB gain improvement over an infinite ground plane antenna. This behavior is explained by the radiation pattern. For very small ground planes (radius<0.25λ) the radiation pattern in the forward direction is broad and there is considerable back lobe radiation. As a result the gain is small. As the ground plane size increases, the beam width becomes narrower and the diffraction causing the back radiation is lessened.

The truncation of the ground plane affects the transverse magnetic (E) and transverse electric (H) planes in a different manner. The beam width for the E-plane pattern is a minimum when the ground plane radius is λ/2. The E-plane pattern broadens when the radius of the ground plane either increases or decreases. For the H Plane, the beam width decreases with a decrease in ground plane size. The pattern symmetry can be improved by controlling the size of the ground plane by exploiting the difference in reaction between the E and H planes.

Regardless of the ground plane size, the current distribution is similar (pattern and magnitude). As the ground plane size decreases, the current density near the edge (perimeter) of the plane also increases. A current induced by the edge diffraction around the edge of the ground plane also increases the current. The current induced on the edge of the ground plane causes radiation. This is prevalent on smaller ground planes. For larger ground planes no appreciable edge currents exist.

Embodiment 1

Figure 1A:
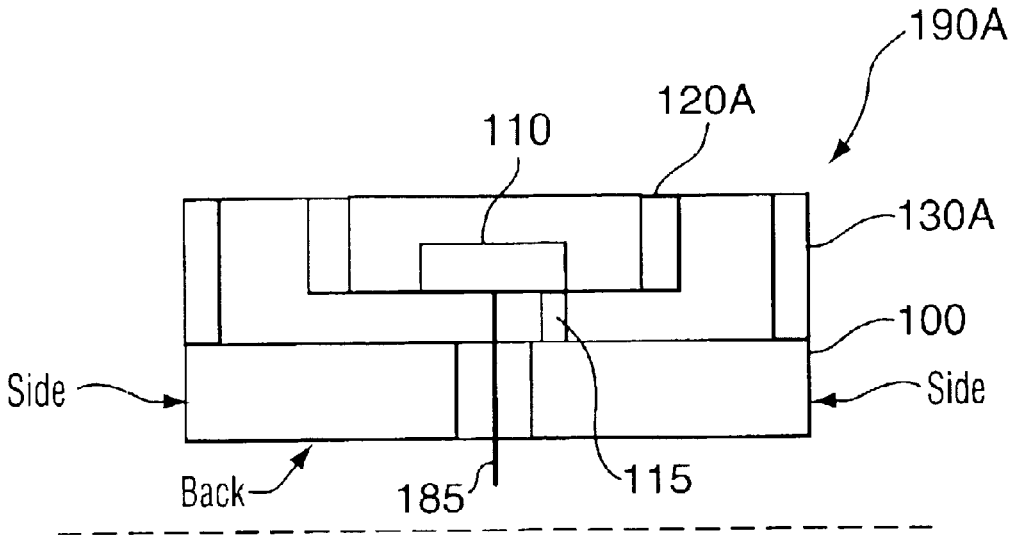
FIGS. 1A&B are schematic representations of an antenna system according to a first embodiment of the present invention.
Figure 1B:
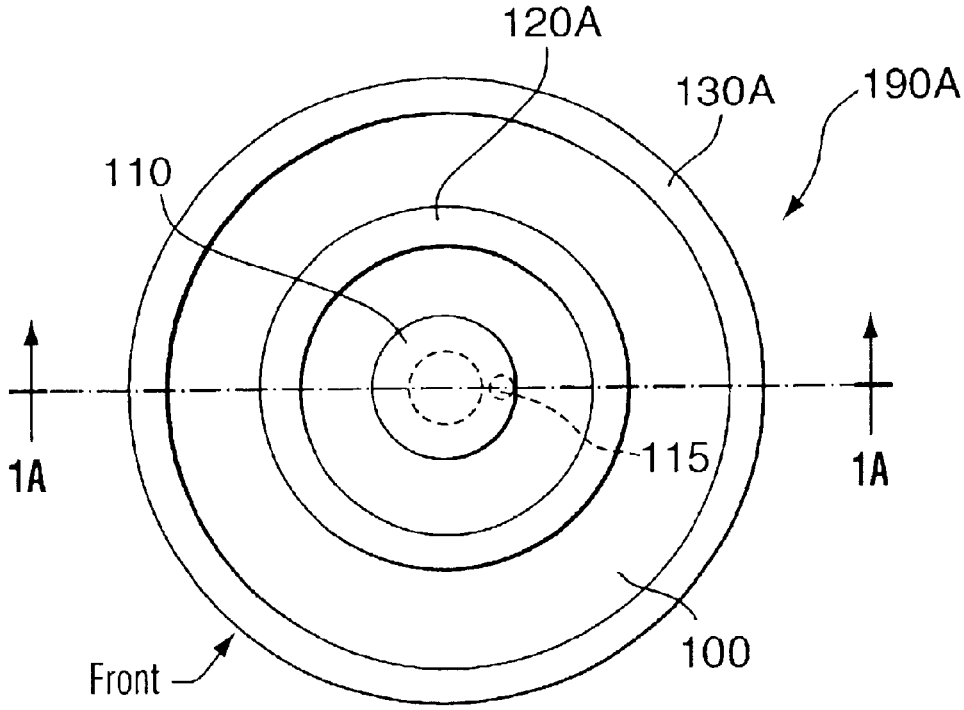

FIGS. 1A&B are schematic representations of an antenna system 190A according to a first embodiment of the present invention. The antenna system 190A comprises a ground plane 100, a radiating element 110 (e.g. a patch in antenna systems of the microstrip type), an isolated conductive structure 120A and a grounded conductive structure 130A. The radiating element 110 is electrically coupled to the ground plane 100 via, for example, a shorting pin 115. Electrical coupling of the patch 110 to the ground plane 100 can be accomplished using other well know techniques such as resistive chip, diode or shorting wall.

Figure 9A:
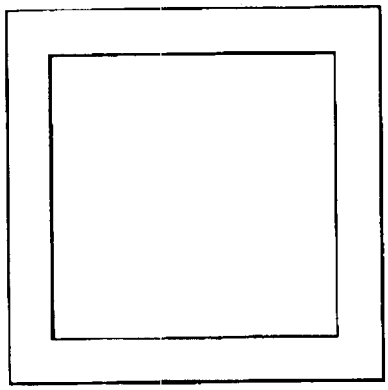
FIGS. 9A,B,C,D,E&F are schematic representations of alternative shapes and configurations that can used in the isolated conductive structure and in the grounded conductive structure of the present invention.
Figure 9B:
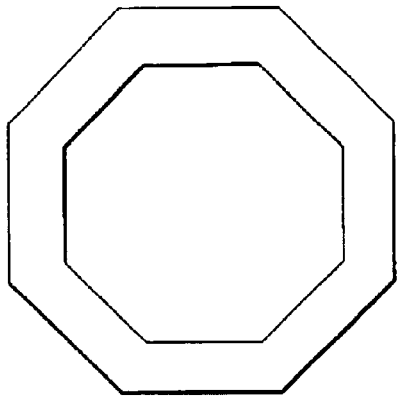
Figure 9C:
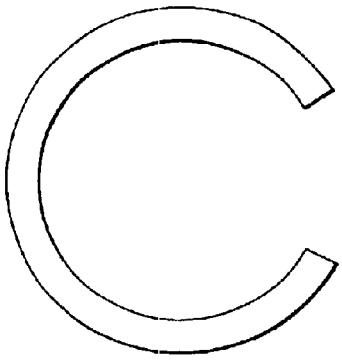

The isolated conductive structure 120A is proximate to, but electrically isolated from, the ground plane 100 and substantially surrounds the radiating element 110 to create a non-planar electromagnetic enclosure of the radiating element 110. In the characterization of the electromagnetic enclosure of the radiating element 110, non-planar refers to the separation of the isolated conductive structure 120A from the ground plane 100. That is—the isolated conductive structure 120A does not occur in a plane formed by the ground plane 100. The isolated conductive structure 120A takes the form of, for example, a circular ring, an other closed shape (e.g. square, rectangle, polygon, etc., see FIGS. 9A&B) or a partially closed shape (e.g. split ring, 'C' shaped, 'U' shaped, etc., see FIGS. 9C&D).

Figure 6A:
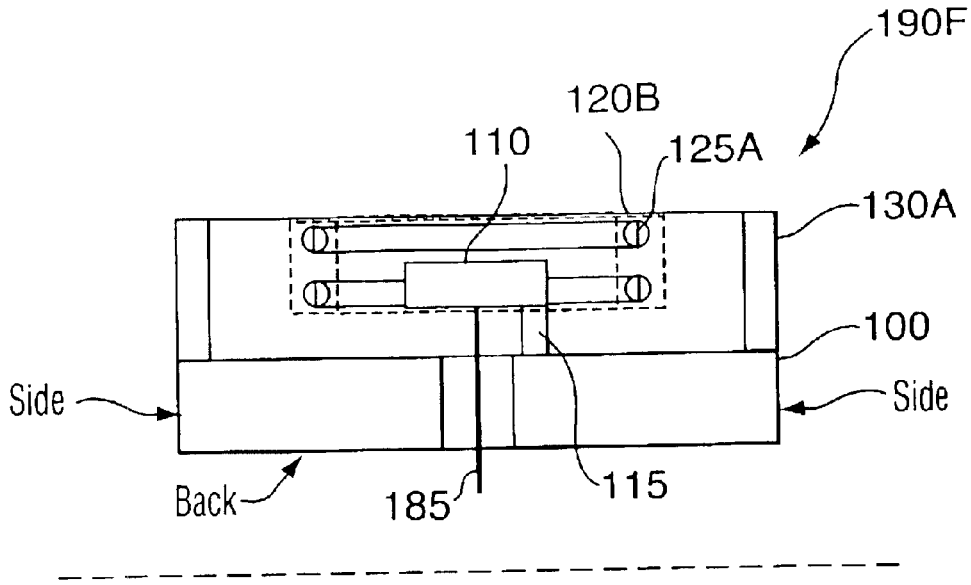
FIGS. 6A&B are schematic representations of an antenna system according to a sixth embodiment of the present invention.
Figure 6B:
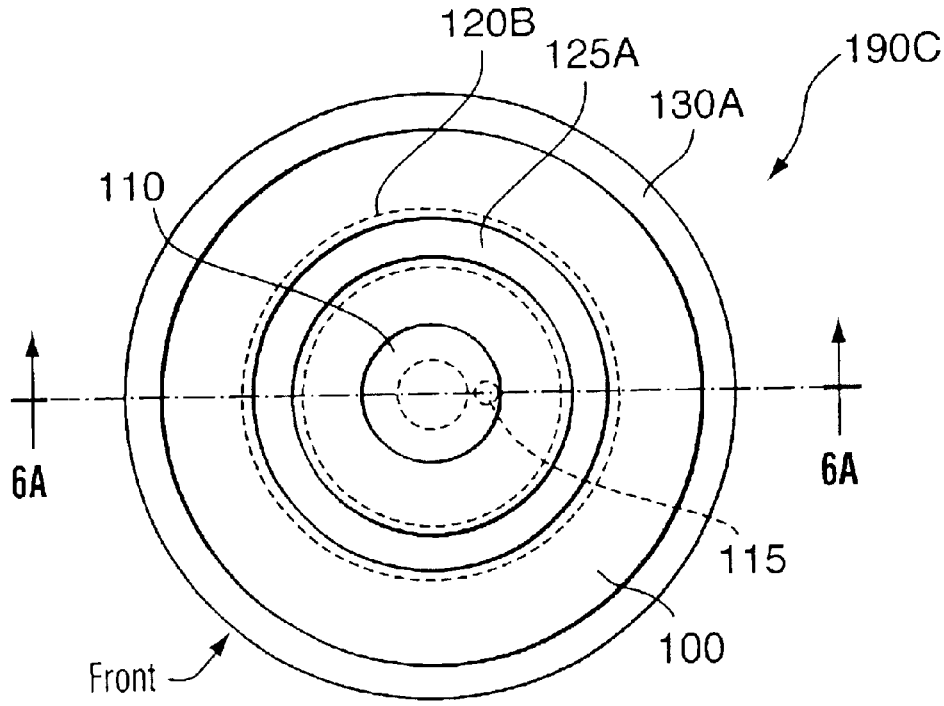
Figure 9E:
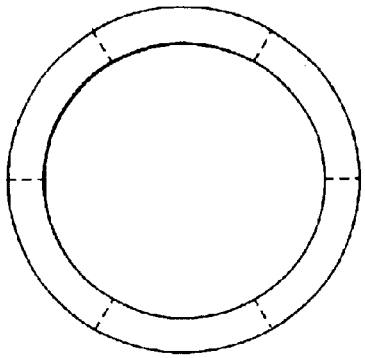
Figure 9D:
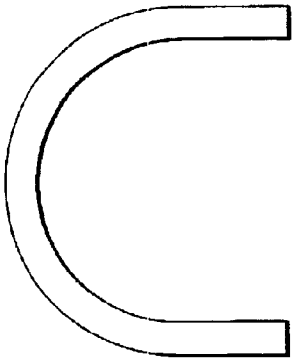
Figure 9F:
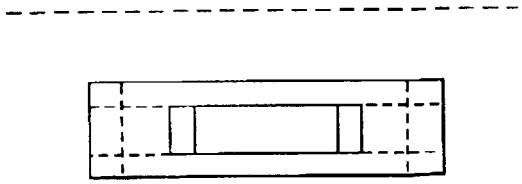

The isolated conductive structure 120A can also take on any of a number of well-known configurations such as solid body (see FIGS. 1A&B), partially solid body (e.g. mesh, slotted, etc., see FIGS. 9E&F) or partially open body (e.g. one or more wire loops, closely spaced individual elements, etc., see FIGS. 6A&B–120B) that support electromagnetic conductivity.

The isolated conductive structure 120A is held in position by, for example, supporting webs (not shown) between the isolated conductive structure 120A and the ground plane 100 or by other similar well known mechanisms (such as spacer rings, suspension arms, etc.) that do not substantially alter the electromagnetic interactions of the elements represented in FIGS. 1A&B.

The resonant frequency of the antenna system 190A is a function of the circumference of the isolated conductive structure 120A. For example, a 19 mm ring has a circumference that equals one wavelength at 2.51 GHz. The resonant frequency determined from the circumference of the isolated conductive structure 120A is matched to the resonant frequency of the radiating element 110.

The grounded conductive structure 130A may take the form of a ring. The grounded conductive structure 130A can also take on other shapes and configurations as described above for the isolated conductive structure 120A. The grounded conductive structure 130A and the isolated conductive structure 120A can be of different shapes and configurations. The grounded conductive structure 130A is electrically coupled to the ground plane 100 by, for example, being in direct contact with the perimeter of the ground plane 100. However, other intermediate structures that do not interfere with the electrical coupling of the grounded conductive structure 130A to the ground plane 100 can be placed between the grounded conductive structure 130A and the ground plane 100. The grounded conductive structure 130A reduces diffraction off of the ground plane 100 minimizing radiation to the back and sides of the antenna system 190A.

Figure 8A:
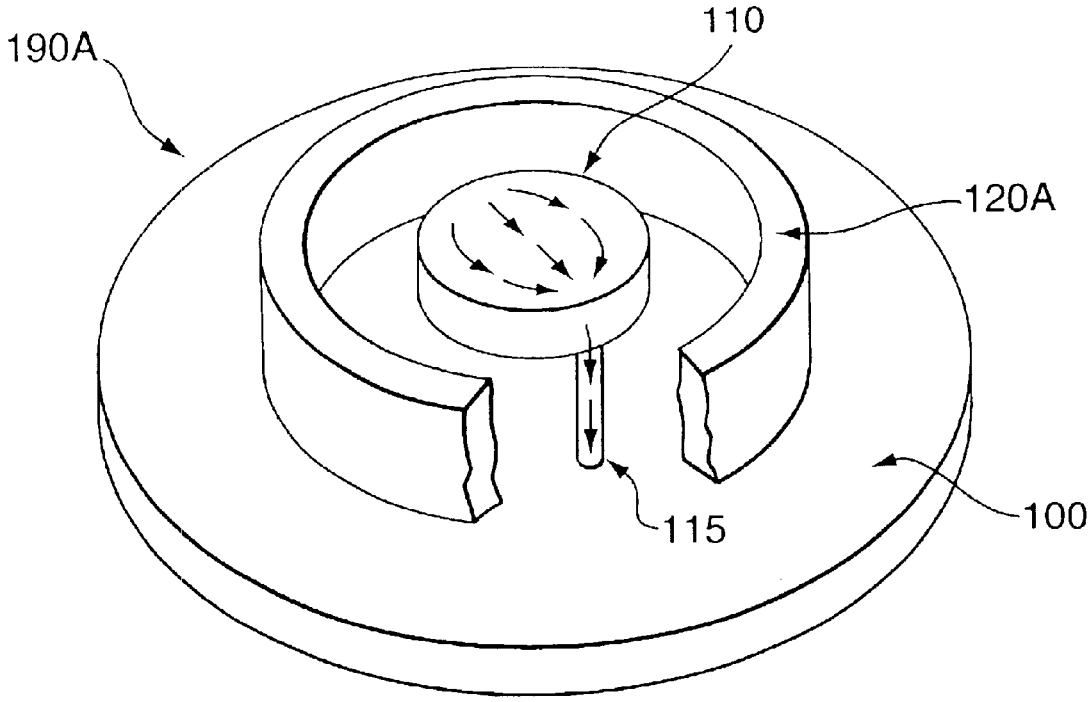
FIGS. 8A,B&C represent current flows in an embodiment of the present invention.
Figure 8B:
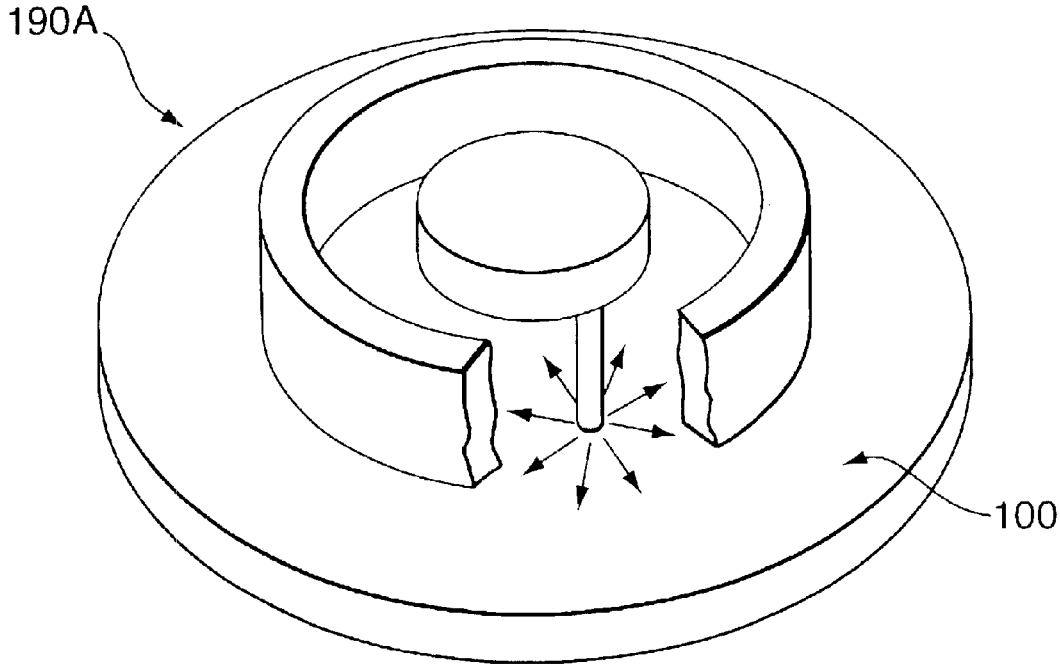
Figure 8C:
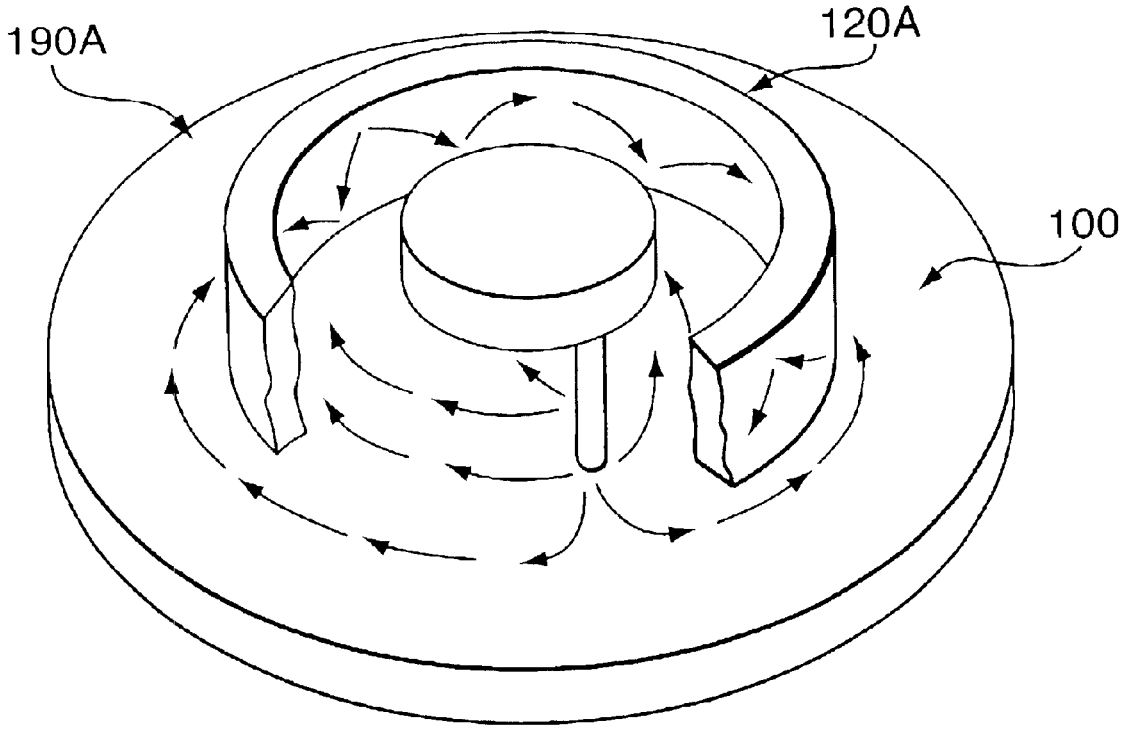

FIGS. 8A,B&C represent perspective views, with partial cut-away sections, showing current flows in the antenna system 190A of the present invention. In operation, the radiating element 110 receives a first current from a radio frequency (RF) source (not shown) via a transmission line 185 that electromagnetically couples the radiating element 110 to the RF source. The first current, represented by arrow-headed vectors, on the radiating element 110 (see FIG. 8A) induces a second current on the ground plane 100. The second current, represented by arrow-headed vectors, flows toward the perimeter of the ground plane 100 (see FIG. 8B). When the second current, flowing toward the perimeter of the ground plan 100, is proximate the isolated conductive structure 120A, a third current, represented by arrow-headed vectors, is induced on the isolated conductive structure 120A opposing the second current (see FIG. 8C). The third current creates an electromagnetic field.

The antenna system 190A of the present invention (as well as further embodiments described hereafter) creates a radiation pattern similar to that of a Yagi-Uda array of loops antenna system. In the present invention the portion of the isolated conductive structure 120A proximate the ground plane 100 acts as an exciter (active element). The opposite (distal) portion of the isolated conductive structure 120A acts as a director. The portion of the ground plane 100 proximate the isolated conductive structure 120A acts as a reflector. Optimal spacing between the elements (i.e. an exciter loop, a director loop and a reflector loop) of the Yagi-Uda array of loops antenna system is 0.1λ. The gain of the antenna system 190A of the present invention increases as the distance between a surface closest to the ground plane 100 and a surface furthest from the ground plane 100, of the isolated ring 120A, increases until a distance (ring height) of approximately 0.1λ is reached.

Embodiment 2

Figure 2A:
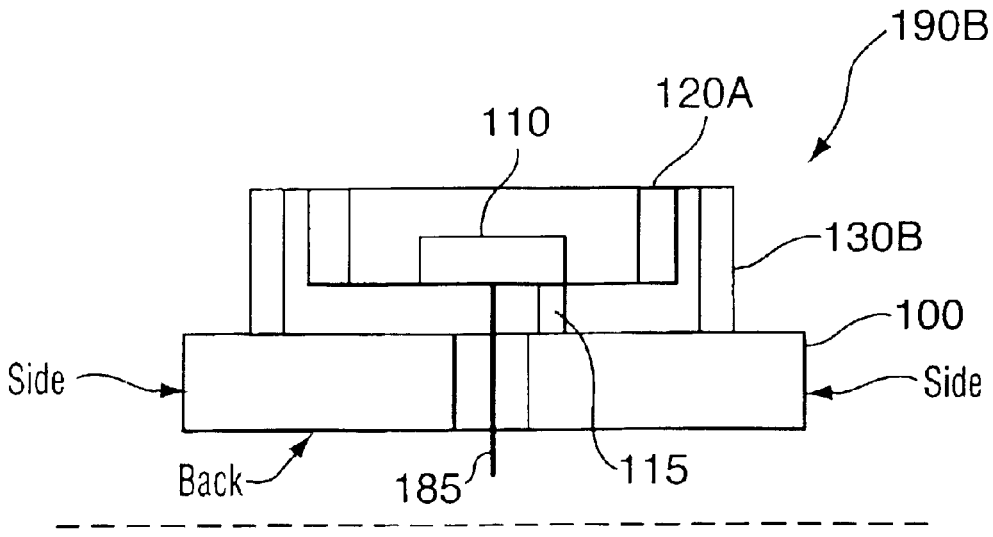
FIGS. 2A&B are schematic representations of an antenna system according to a second embodiment of the present invention.
Figure 2B:
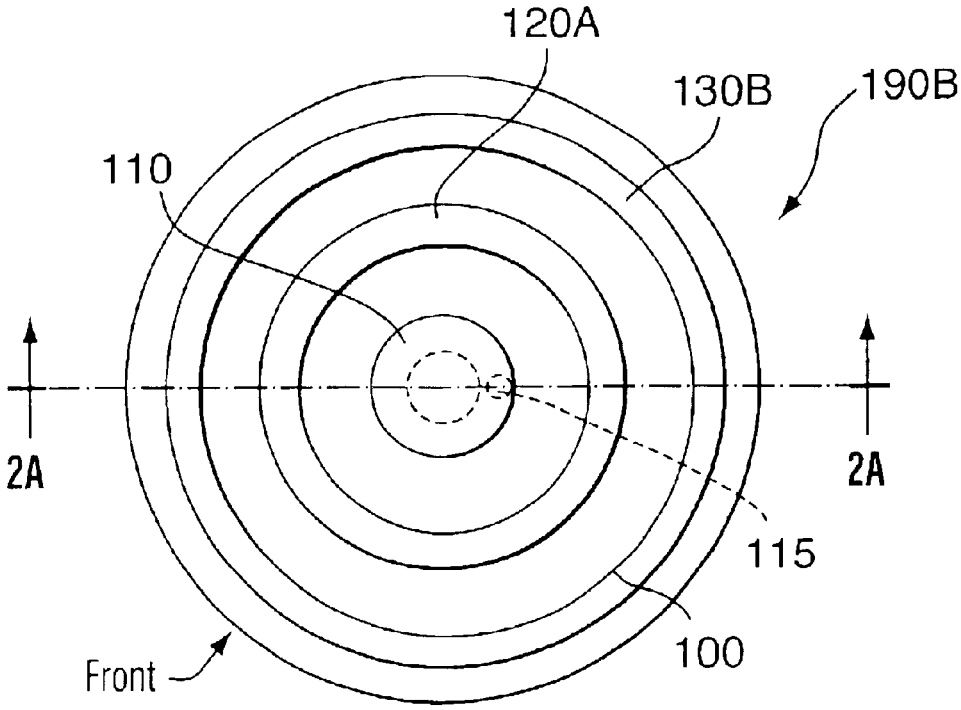

FIGS. 2A&B are schematic representations of an antenna system 190B according to a second embodiment of the present invention. The antenna system 190B comprises elements similar to those of the antenna system 190A and operation is similar as well. In the antenna system 190B a grounded conductive structure 130B is located and in contact with the ground plane 100 in an area spaced between the isolated conductive structure 120A and the perimeter of the ground plane 100. The grounded conductive structure 130B operates similarly to the ground conductive structure 130A to reduce diffraction off of the ground plane 100 minimizing radiation to the back and sides of the antenna system 190B.

Embodiment 3

Figure 3A:
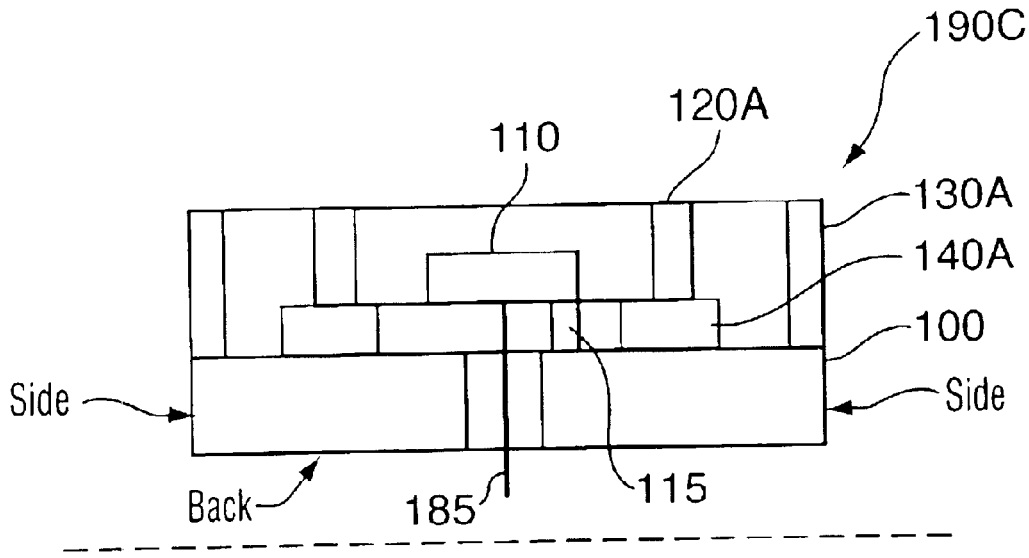
FIGS. 3A&B are schematic representations of an antenna system according to a third embodiment of the present invention.
Figure 3B:
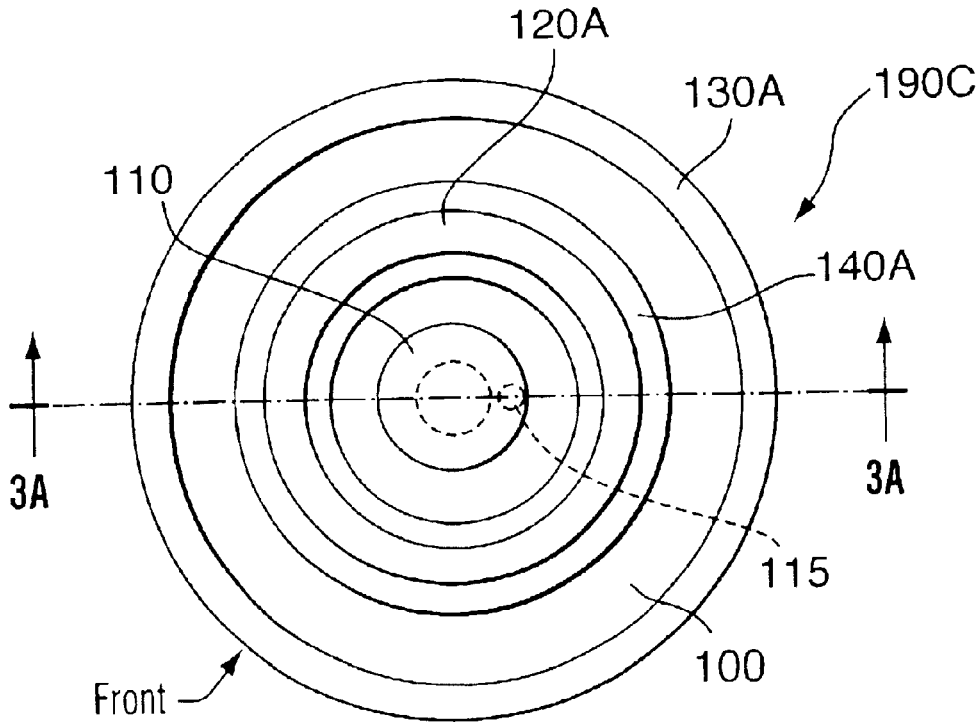

FIGS. 3A&B are schematic representations of an antenna system 190C according to a third embodiment of the present invention. The antenna system 190C comprises elements similar to those of the antenna system 190A and operation is similar as well. In the antenna system 190C a dielectric element 140A occupies a gap between the ground plane 100 and the isolated conductive structure 120A thereby taking the place of an air gap that exists between these elements in the antenna system 190A. Acceptable shapes for the dielectric element 140A include configurations that enclose a portion of isolated conductive structure 120A.

Although the dielectric element 140A is composed of material having a specific dielectric constant, an effective dielectric constant will result from the specific dielectric constant in combination with other characteristics of the antenna system 190C including, for example, the size and shape of the dielectric element 140A. As a result of the effective dielectric constant, an isolated conductive structure 120A of a smaller circumference is used for a given resonant frequency compared to the antenna system 190A. The radius for the isolated conductive structure 120A can be calculated using:

$$\text{Radius}=\lambda/(2\pi\sqrt{\epsilon_{EFF}})$$

where $\lambda$ is the wavelength at the resonant frequency and $\epsilon_{EFF}$ is the effective dielectric constant.

Embodiment 4

Figure 4A:
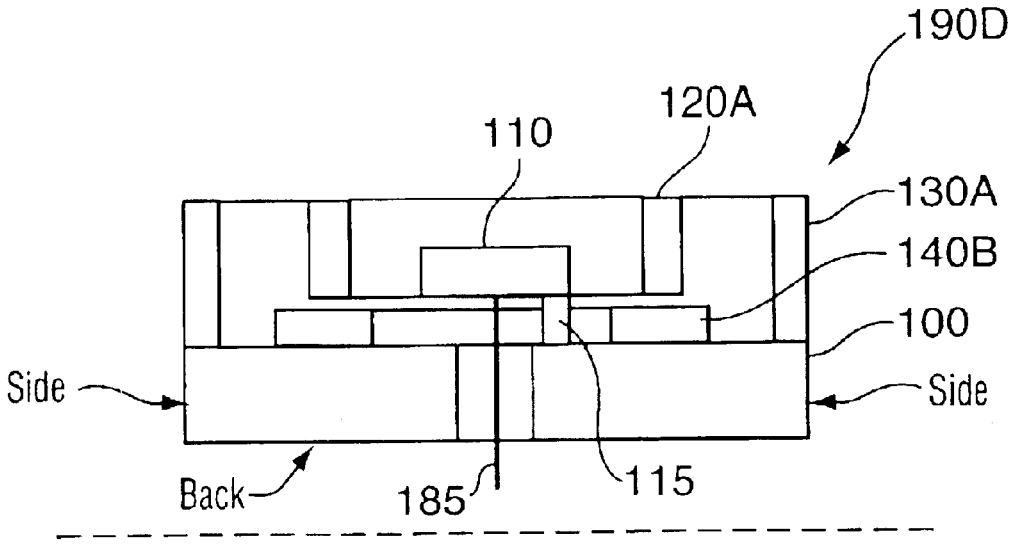
FIGS. 4A&B are schematic representations of an antenna system according to a forth embodiment of the present invention.
Figure 4B:
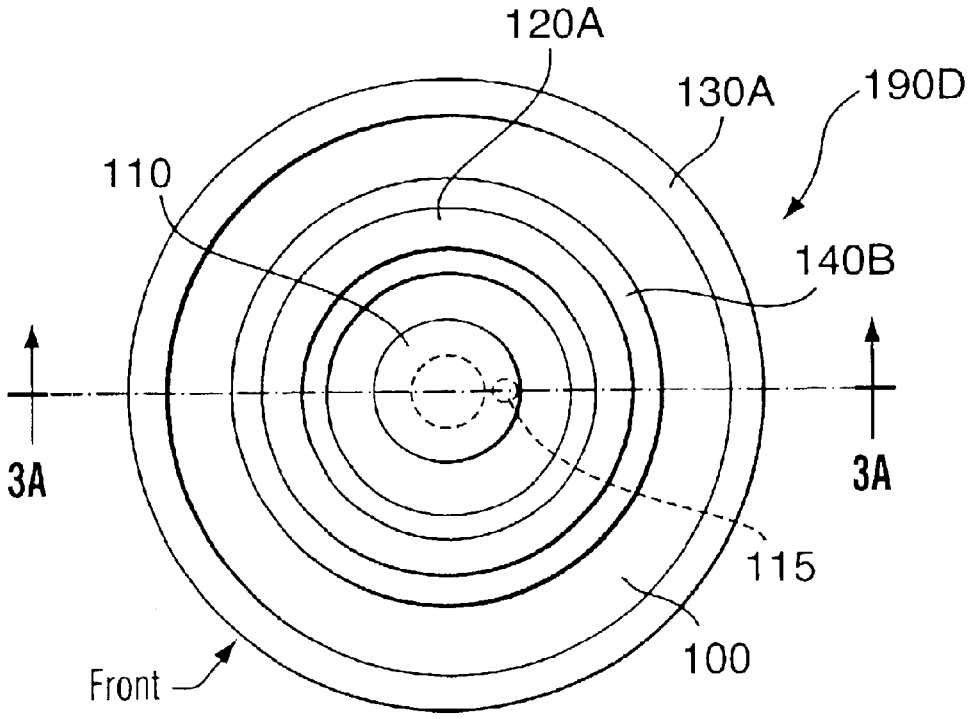

FIGS. 4A&B are schematic representations of an antenna system 190D according to a forth embodiment of the present invention. The antenna system 190D comprises elements similar to those of the embodiment represented in the antenna system 190C and operation is similar as well. In the antenna system 190D a dielectric element 140B takes the place of a portion of the gap between the ground plane 100 and the isolated conductive structure 120A. A remaining portion of the gap between the ground plane 100 and the isolated conductive structure 120A forms an air gap.

In addition to the factors mentioned above for the antenna system 190C that contribute to an effective dielectric constant, the air gap in the antenna system 190D also contributes to the effective dielectric constant.

Embodiment 5

Figure 5A:
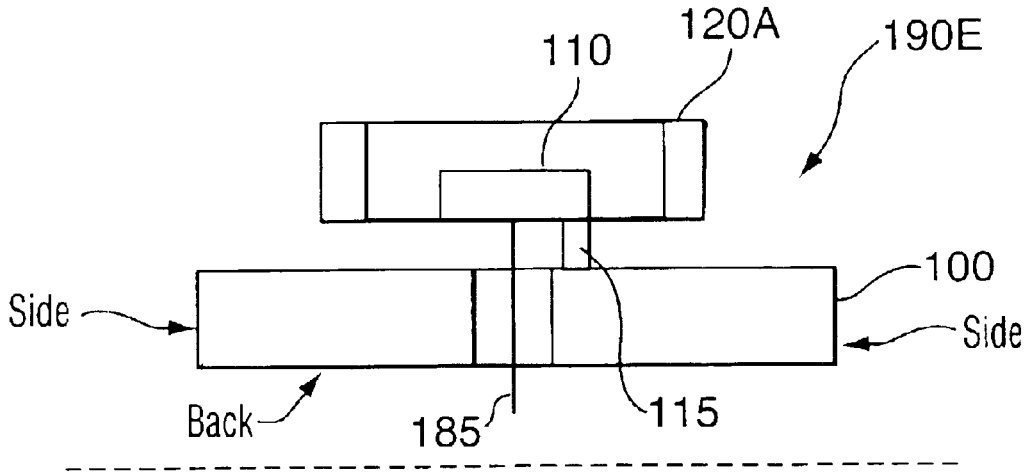
FIGS. 5A&B are schematic representations of an antenna system according to a fifth embodiment of the present invention.
Figure 5B:
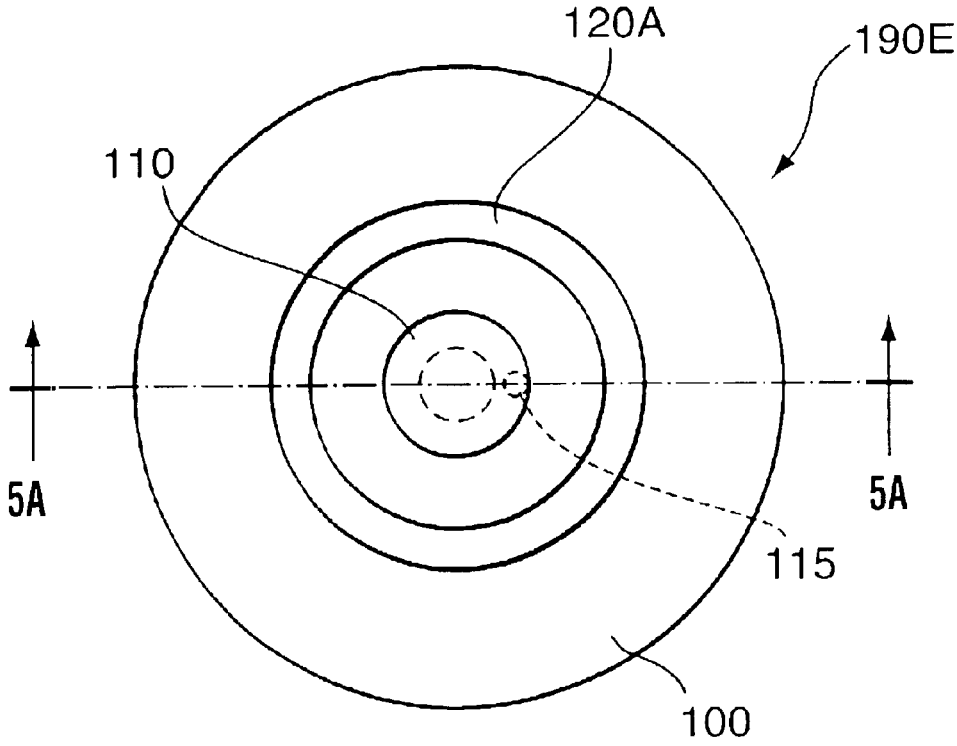

FIGS. 5A&B are schematic representations of an antenna system 190E according to a fifth embodiment of the present invention. The antenna system 190E comprises elements similar to the antenna system 190A and operation is similar as well with the exception that the grounded conductive structure 130A is not included.

The grounded conductive structure 130A of the antenna system 190A reduces diffraction off of the ground plane 100 thereby controlling radiation to the back and sides of the antenna system resulting in greater gain in the front beam of the antenna system 190A. The exclusion of the grounded conductive structure 130A in the antenna system 190E results in the loss of reduction in diffraction off of the ground plane 100. The impact of this loss is mitigated by the presence of the isolated conductive structure 120A that minimizes ground plane 100 current interaction with the edge of the ground plane 100.

Embodiment 6

FIGS. 6A&B are schematic representations of an antenna system 190F according to a sixth embodiment of the present invention. The antenna system 190F comprises elements similar to those of the antenna system 190A and operation is similar as well. An isolated conductive structure 120B, comprising an upper wire ring 125A and a lower wire ring 125B, replaces the isolated conductive structure 120A. Together the two wire rings 125A, 125B operate similarly to the isolated conductive structure 120A in the antenna system 190A. The lower wire ring 125B acts as an exciter (active element) similarly to the portion of the isolated conductive structure 120A proximate the ground plane 100 in the antenna system 190A. The upper wire ring 125A acts as a director similarly to the opposite (distal) portion of the isolated conductive structure 120A in the antenna system 190A.

Embodiment 7

Single element antenna systems normally have a relatively wide beam radiation pattern. An increase in electrical size of the antenna system can be used to narrow the beam width. This can be accomplished by either enlarging the size of the single element antenna system or by using a number of smaller antenna systems (elements) arranged in an array.

Figure 7:
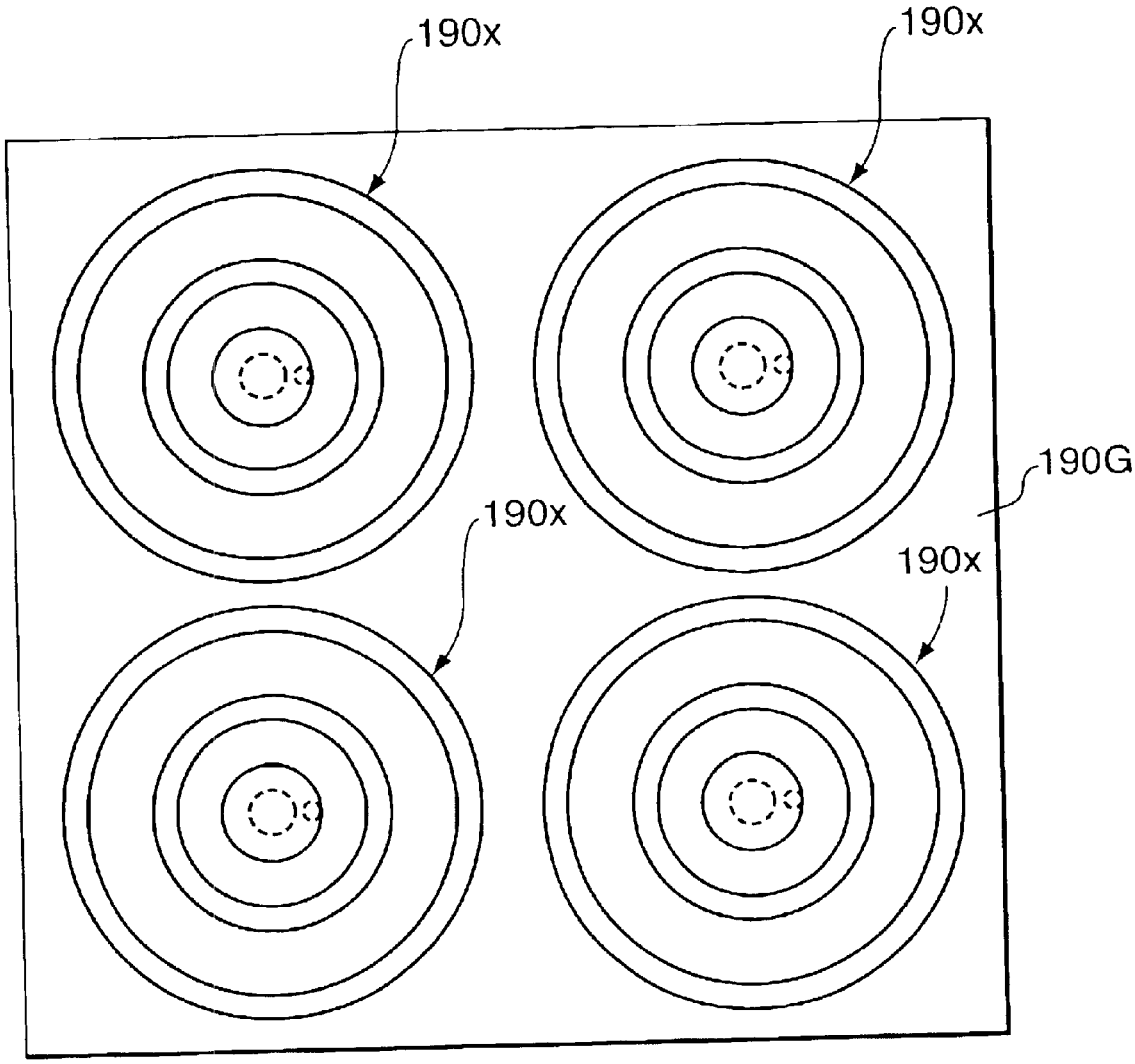
FIG. 7 is a schematic representation of an antenna system of the present invention that comprises a 2×2 array of elements.

FIG. 7 is a schematic representation of an antenna system 190G of the present invention that comprises a 2×2 array of elements each according to an antenna system 190X. The antenna system 190X can be any of the antenna system embodiments 190A–F according to the present invention. The antenna system 190G can be constructed using other geometric embodiments for the array (linear, circular, rectangular, etc) and different numbers of elements within the array. The array of elements can be operatively connected using known power divider, microstrip feed network, or other similar power distribution mechanisms. The radiation pattern from the array of elements is a vector addition of patterns of each individual element. The shape of the radiation pattern for the array of elements can be engineered using well known techniques taking into consideration, for example, the geometrical embodiment of the overall array, the relative displacement between elements, the excitation amplitude of the individual elements, the excitation phase of the individual elements and the radiation pattern of the individual elements.

In summary, the present invention describes various systems 190A–F that enable the reduction in the overall size of a microstrip antenna using a design that includes, for example, a ground plane, a shorted patch surrounded by a non-planar ring and a grounded ring surrounding the non-planar ring. Other arrangements of the antenna system such as, for example, an array made up of elements according to the design are within the scope of the present invention. These embodiments achieve a size reduction by reducing the overall size of the ground plane while mitigating the negative performance impacts normally associated with sub-optimal ground plane size.

It will be apparent to one skilled in the art that numerous modifications to and departures from the specific embodiments described herein may be made without departing from the spirit and scope of the present invention.

What is claimed is:

1. An antenna system comprising:

a ground plane;

a radiating element electrically coupled to the ground plane; and a conductive structure electrically isolated from the ground plane and confiured to electromagnetically enclose the radiating element.

2. The antenna system of claim 1, further comprising:

a grounded conductive structure, electrically coupled to the ground plane, and configured to reduce a diffraction off of the ground plane.

3. The antenna system of claim 1, wherein the conductive structure is one of a closed shape and a partially closed shape.

4. The antenna system of claim 1, wherein the conductive structure includes a ring.

5. The antenna system of claim 1, wherein the conductive structure is one of a solid body, a partially solid body and a partially open body.

6. The antenna system of claim 1, wherein the conductive structure includes a pair of wire rings.

7. The antenna system of claim 2, wherein the grounded conductive structure is one of a closed share and a partially closed shape.

8. The antenna system of claim 2, wherein the grounded conductive structure includes a ring.

9. The antenna system of claim 2, wherein the grounded conductive structure is one of a solid body, a partially solid body and a partially open body.

10. The antenna system of claim 2, wherein the grounded conductive structure is in contact with a perimeter of the ground plane.

11. The antenna system of claim 1, further comprising:

a dielectric element positioned between the conductive structure and the ground plane.

12. An antenna system array comprising a plurality of antenna system elements each according to the antenna system of claim 1.

13. An antenna system comprising:

means for rounding;

means for radiating electrically coupled to the means for grounding;

first means for conducting electrically isolated from the means for grounding and arranged such that a first current on the means for radiating induces a second current on the means for grouding proximate the first means for conducting thereby inducing a third current on the first means for conducting opposing the second current, wherein the third current creates an electromagnetic field.

14. The antenna system of claim 13, further comprising:

second means for conducting, electrically coupled to the means for grounding, for reducing a diffraction off of the means for grounding.

15. The antenna system of claim 13, wherein the first means for conducting is one of a closed shape and a partially closed shape.

16. The antenna system of claim 13, wherein the first means for conducting includes a ring.

17. The antenna system of claim 13, wherein the first means for conducting is one of a solid body, a partially solid body and a partially open body.

18. The antenna system of claim 13, wherein the first means for conducting includes a pair of wire rings.

19. The antenna system of claim 14, wherein the second means for conducting is one of a closed shape and a partially closed shape.

20. The antenna system of claim 14, wherein the second means for conducting includes a ring.

21. The antenna system of claim 14, wherein the second means for conducting is one of a solid body, a partially solid body and a partially open body.

22. The antenna system of claim 14, wherein the second means for conducting is in contact with a perimeter of the means for grounding.

23. The antenna system of claim 13, further comprising:

means for electrical isolation positioned between the first means for conducting and the means for grounding.

24. An antenna system array comprising a plurality of antenna system elements each according to the antenna system of claim 13.

25. An antenna system comprising:

a finite ground plane;

a radiating element electrically coupled to the ground plane;

an isolated conductive ring, not in electrical contact with the ground plane, substantially surrounding the radiating element; and a grounded conductive ring, electrically coupled to the ground plane, substantially in contact with a perimeter of the ground plane.

26. The antenna system of claim 25, wherein the isolated conductive ring is one of a solid body, a partially solid body and a partially open body.

27. The antenna system of claim 25, wherein the isolated conductive ring includes a pair of wire rings.

28. The antenna system of claim 25, wherein the grounded conductive ring is one of a solid body, a partially solid body and a partially open body.

29. The antenna system of claim 25, further comprising:

a dielectric element positioned between the isolated conductive ring and the finite ground plane.

30. An antenna system array comprising a plurality of antenna system elements each according to the antenna system of claim 25.

* * * * *